United States Patent [19]

Mahr et al.

[11] 4,322,197

[45] Mar. 30, 1982

[54] PROCESS AND INSTALLATION FOR CHARGING A SHAFT FURNACE

[75] Inventors: René Mahr, Howald-Hesperange; Henri Radoux, Luxembourg; Pierre Mailliet, Howald; Emile Lonardi, Bascharage, all of Luxembourg

[73] Assignee: Paul Wurth, S.A., Grand Duchy of Luxembourg, Fed. Rep. of Germany

[21] Appl. No.: 62,969

[22] Filed: Aug. 2, 1979

[30] Foreign Application Priority Data

Dec. 8, 1978 [LU] Luxembourg ..... 80630

[51] Int. Cl.[3] ..... B66C 17/08

[52] U.S. Cl. ..... 414/206; 414/21; 414/161; 266/184

[58] Field of Search ..... 414/21, 160, 161, 168, 414/169, 170, 199–206; 266/183, 184

[56] References Cited

U.S. PATENT DOCUMENTS 3,056,518 10/1962 Powell ..... 414/170
3,704,992 12/1972 Nieboer ..... 414/169
4,067,452 1/1978 Berzins ..... 414/201
4,151,047 4/1979 Legille et al. ..... 414/169

*Primary Examiner*—Lawrence J. Oresky
*Attorney, Agent, or Firm*—Fishman & Van Kirk

[57] ABSTRACT

Material to be deposited on the hearth of a shaft furnace serially passes through a pair of temporary storage containers positioned above the furnace. The uppermost storage container is in the form of a bin open to the ambient atmosphere while the lower storage container is provided with valves at either end whereby it may be hermetically sealed and subsequently brought to furnace pressure. The lower storage container is loaded while at ambient pressure, by releasing furnace charge material previously delivered to the upper storage container into the lower container and subsequently by delivering material directly to the lower container from a conveyor system through the lower container. The upper container is refilled with material while the lower container is at furnace pressure and is discharging its contents into the furnace.

5 Claims, 7 Drawing Figures

PROCESS AND INSTALLATION FOR CHARGING A SHAFT FURNACE

BACKGROUND OF THE INVENTION (1) Field of the Invention

The present invention relates to methods for the delivery of charge material to the interior of a shaft furnace and to apparatus for use in the practice of such methods. More specifically, this invention is directed to charging installations for blast furnaces and particularly to apparatus for delivering the raw material with which a furnace is to be charged to a rotary distribution chute positioned within the furnace. Accordingly, the general objects of the present invention are to provide novel and improved methods and apparatus of such character.

(2) Description of the Prior Art

One of the most significant recent advances in blast furnace technology is the charging installation known in the art as the "bell less top". The "bell less top" is disclosed in U.S. Pat. No. 3,693,812. Reference may also be had to U.S. Pat. Nos. 3,929,240, 4,042,130, 4,071,166 and 4,074,816. The "bell less top" charging installation employs a rotary and angularly adjustable distribution chute which, prior to the present invention, has been supplied with material from a pair of intermediate storage hoppers. The success of the "bell less top" charging system is attributable to the fact that, by enabling the charging process to be more accurately controlled than has previously been possible, it has permitted the operating limits of furnaces which would otherwise have been equipped with conventional bell-type charging devices to be exceeded. The significant increase in the degree of control which may be exercised over the operation of a blast furnace with a "bell less top" allows furnace output to be optimized.

For further description of the construction and operation of the "bell less top", reference may be had to the aforementioned patents.

As noted above, prior "bell less top" charging installations have been characterized by a pair of juxtapositioned intermediate storage hoppers which were alternately placed in communication with the interior of the furnace, and thus the charge distribution chute, by apparatus which includes a material flow control or dosing valve. Isolation valves were also provided at both the feed and discharge ends of the intermediate storage hoppers since the hoppers must alternately be at atmospheric pressure to permit loading and at furnace pressure to permit discharging. The use of a pair of intermediate storage hoppers enables the charging of the furnace to proceed on an essentially continuous basis; the only interruptions necessitated being during the opening and closing of the isolation valves. Thus, in accordance with prior "bell less top" technology, a plurality of intermediate storage hoppers are employed and one storage hopper was filled while another was discharging its contents into the furnace. This results in the significant advantage that the productivity of the furnace is not limited by the charging installation.

The "bell less top" charging installations of the referenced patents, while unquestionably highly desirable for employment on modern large-capacity furnaces, are somewhat less cost effective for medium and small capacity blast furnaces. Further, both equipment costs and installation costs must be taken into account should it be desired to retrofit an existing furnace with a "bell less top" so as to upgrade the furnace. Thus, where an existing blast furnace is to be modernized by replacement of a bell-type charging installation with a "bell less top", the furnace operator must take into account the cost of the new apparatus and also the expenses which may be incurred in fitting the new apparatus to his existing furnace. The modernizing expense will, of course, include the cost of converting or modifying existing equipment such as the apparatus for conveying the charge material to the furnace, the super-structure which includes the bell tower, the foot bridges, etc. All of these expense factors have often worked to prevent the upgrading of existing furnaces by replacing their charging installations with charging apparatus of the "bell less top" type and have also resulted in decisions not to employ the "bell less top" on small and medium capacity blast furnaces.

SUMMARY OF THE INVENTION

The present invention has, as its principal object, alleviation of the above-discussed economic penalties through the provision of a new furnace charging system and technique which permits the "bell less top" technology to be adapted to small and medium capacity furnaces and also to be retrofitted onto existing furnaces with comparative ease. In achieving this primary objective, a charging installation in accordance with the present invention is characterized by a single intermediate storage hopper which is itself fed from a further temporary storage chamber or bin which is open to the ambient atmosphere. The delivery of material from the temporary storage bin into the intermediate storage hopper is controlled by an isolation valve. The isolation valve, which preferably has a valve member of "mushroom" shape, hermetically isolates the interior of the intermediate storage hopper from the ambient atmosphere and also supports charge material in the bin when in the closed position. The valve, when in the open position, permits rapid delivery of material into the intermediate storage hopper and distributes that material within the hopper in a circular pattern.

The present invention eliminates the need for a plurality of intermediate storage hoppers in a "bell less top" furnace charging installation and thus eliminates the various ancillary items of equipment which are required for a second such hopper in a "bell less top". These ancillary items of equipment include isolation valves, pressurization and depressurization devices, etc. Further, the elimination of the second intermediate storage hopper significantly reduces the space requirements for the "bell less top" charging installation and, in so doing, affords flexibility in selection of an installation position which will be compatible with existing equipment thereby minimizing installation costs. In particular, the single intermediate storage hopper of the charging installation of the present invention can be mounted between the uprights of the bell tower of a conventional charging installation.

The present invention has also necessitated devising a new charging process which permits the furnace to be charged in the shortest possible time; i.e., the present invention fulfills the criteria of charging the furnace without paying a significant penalty due to loss of the ability to load a first intermediate storage hopper while another intermediate storage hopper is having its contents discharged into the furnace. A charging process in accordance with the present invention is characterized by the cyclic combination of the following steps:

(a) Closing of the isolation valve between the intermediate storage hopper and the temporary storage bin;

(b) Pressurizing the intermediate storage hopper and subsequently establishing communication between the hopper interior and the interior of the furnace;

(c) Discharge of the contents of the intermediate storage hopper into the furnace while simultaneously filling the temporary storage bin;

(d) Isolation of the intermediate storage hopper from the furnace and depressurization thereof;

(e) Opening of the isolation valve to rapidly deliver the contents of the temporary storage bin into the intermediate storage hopper; and (f) Introduction of additional charge material into the temporary storage bin and directly therethrough into the intermediate storage hopper while the isolation valve remains in the open condition.

The charging process outlined above is advantageously performed in a charging installation which is equipped with a feed device for the charge material which consists of a ramp with at least a pair of skips which are controlled so that while one skip is being loaded the other is discharging its contents into the temporary storage bin and vice versa. Thus, in one embodiment of a process in accordance with the present invention each charging "cycle" comprises the introduction into the furnace of a charge of material having a volume corresponding to the contents of the two skips. In this embodiment the delivery of charge material into the intermediate storage hopper during the steps (e) and (f) corresponds to the emptying of the first and second skips respectively and the delivery of material into the furnace in step (c) will consist of the passage into the furnace of a quantity of material equal to the contents of two skips. In accordance with a second embodiment, the quantity of material delivered to the furnace during step (c) corresponds to the volume of three skips and the temporary storage bin will receive the contents of two skips during either of steps (c) or (f).

Also in accordance with the present invention, the furnace charging process is automatically controlled in accordance with the contents of the intermediate storage hopper as determined by weighing. Thus, the intermediate storage hopper will be supported on load cells and will be dynamically isolated from the furnace and from the temporary storage bin by means of flexible compensator connections.

BRIEF DESCRIPTION OF THE DRAWING

The present invention may be better understood and its numerous objects and advantages will become apparent to those skilled in the art by reference to the accompanying drawing wherein like reference numerals refer to like elements in the several FIGURES and in which.

DESCRIPTION OF THE PREFERRED EMBODIMENTS

Figure 1:
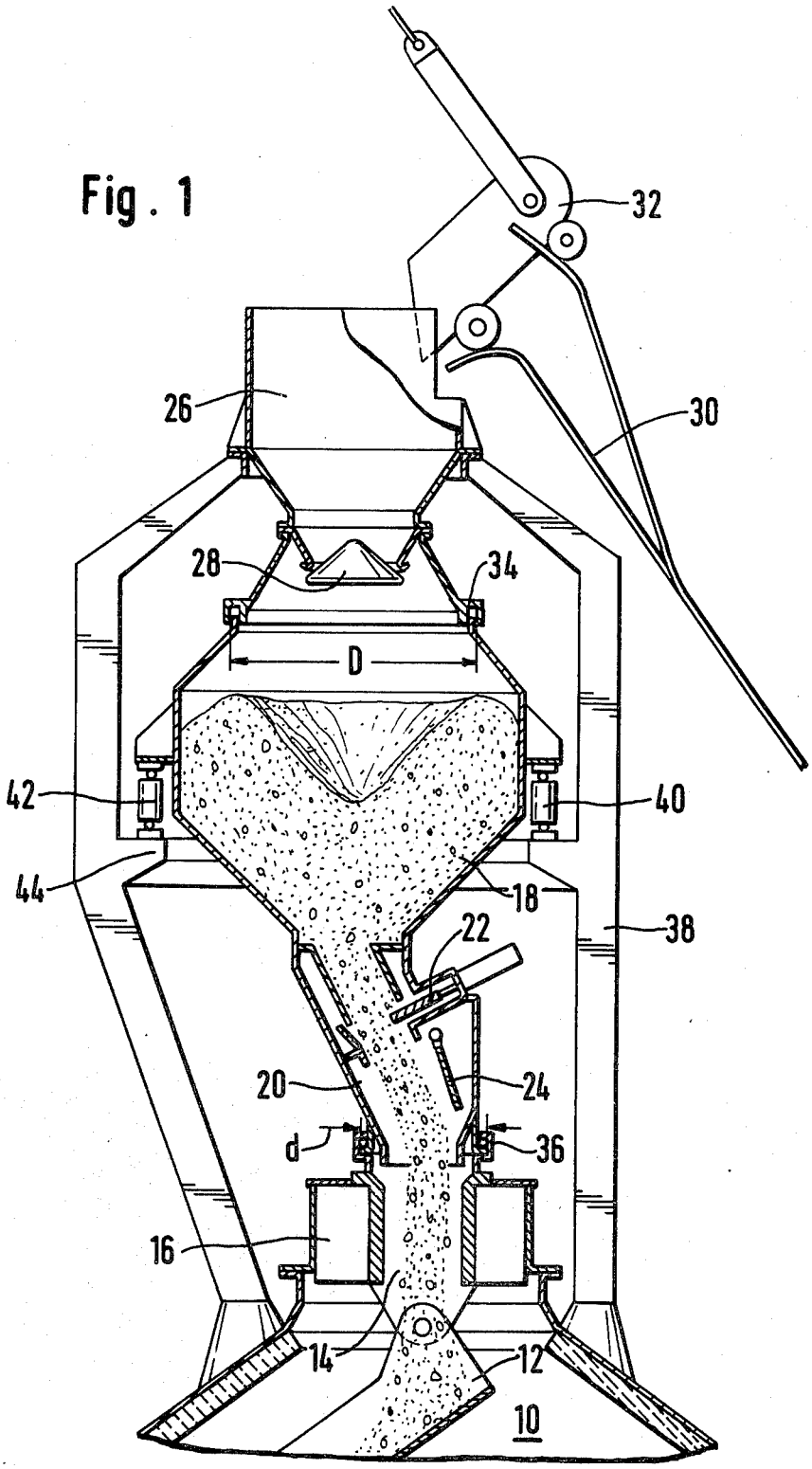
FIG. 1 is a schematic side elevation view, partly in section, of a shaft furnace charging installation in accordance with the present invention.

With reference now to FIG. 1, the top or throat section of a shaft furnace is indicated generally at 10. A rotatable and angularly adjustable charge distribution chute 12 is mounted in furnace 10 such that its material receiving end is aligned with the lower end of a vertical feed channel 14. The distribution chute 12 is driven, and thus controlled in position by, a mechanism 16 which may be of the type described in Belgium Pat. No. 801,031 or Luxembourg Patent application No. 80,112. Prior art drive mechanisms for chute 12 are disclosed in U.S. Pat. Nos. 3,693,812, 3,814,403, 3,864,984, 3,880,302 and 4,042,130. In accordance with the present invention, the introduction of material with which the furnace is to be charged is effected via a "shut-off device" comprising a single intermediate storage hopper 18. Hopper 18 communicates with vertical feed channel 14 via a spout sub-assembly 20. A material flow control or dosing device 22 and a shut-off or isolation valve 24 are, in the manner known in the art, provided within spout sub-assembly 20.

According to one of the features of the present invention, the intermediate storage hopper 18 is surmounted by a further device for temporarily storing material with which the furnace is to be charged. This further temporary storage device consists of an open-topped chamber or bin 26. Communication between bin 26 and hopper 18 is controlled by means of an isolation valve 28. Valve 28 has a peripheral seating surface which interacts with a seat which is provided about the base of the lower frustoconical portion of bin 26. Valve 28, when in the closed position, hermetically seals the interior of hopper 18 from the ambient atmosphere. Valve 28 is operated by means, which have been omitted from FIG. 1 in the interest of clarity, including a swivel arm. The closure member of valve 28 is of the mushroom-shaped type, as shown in the drawing, whereby the valve can perform the secondary function of distributing the charge material exiting from bin 26 in rings in hopper 18. Valve 28 thus performs the three functions of insuring hermetically between hopper 18 and bin 26, permitting rapid discharge of material from bin 26 into hopper 18 when in the open position and controlling distribution of material falling from bin 26 into hopper 18. By employing valve 28 to perform functions which would otherwise require the use of separate material flow control and hermetic isolation valves, the height of the entire charging installation may be restricted. It is to be noted that in prior art "bell less top" charging installations the upper isolation valves associated with the storage hoppers performed only the function of insuring a hermetic seal between the interior of the hopper and the ambient atmosphere thus did not function to retain and/or regulate the flow of charge material being loaded into the intermediate storage hoppers. As evidenced by the above-referenced patents, in the prior art furnace charged material was not temporarily stored in any type of chamber or reservoir immediately upstream of the intermediate storage hopper.

Continuing with a discussion of FIG. 1, the material with which the furnace is to be charged is delivered to bin 26 by skips or buckets 32 which move on an inclined ramp 30. In accordance with one embodiment of the invention, a pair of skips 32 will travel in alternation with one skip descending the ramp 30 while the other is ascending to the position shown by skip 32 in FIG. 1.

In order to exercise control over the furnace charging operation, the rate of charge material flow into and out of intermediate storage hopper 18 is monitored by a weighing operation. The net weight of the material present in hopper 18 is computed by deducting the tare from the measured weight. The tare is the weight which is present between an upper compensator 34 and a lower compensator 36 when no charge material is in hopper 18. In order to measure the weight of the storage hopper 18 and its contents, the hopper must be capable of acting on the load cells and thus there can be no rigid communication between intermediate storage hopper 18 and the furnace 10. Accordingly, a flexible compensator 36 couples the charging installation, with the exception of feed channel 14 and distribution chute 12 and its drive mechanism, to furnace 10. Further, since the weight of bin 26 and its contents cannot be included in the tare, which must be constant, a flexible connection is also required between intermediate storage hopper 18 and bin 26. Since the prior art did not contemplate serial temporary storage of furnace charge material, with gravity feed from one storage position to the next, there has previously been no requirement for flexible coupling between an intermediate storage hopper and any portion of a furnace charging installatin physically positioned above the intermediate storage hopper.

The weighing operation is performed by three or four load cells such as the cells indicated at 40 and 42 in FIG. 1. The load or measuring cells are typically of the piezoelectric variety and measure the force exerted by the weight of intermediate storage hopper 18 and its contents. As shown in FIG. 1, the load cells 40 and 42 are mounted on an inwardly extended ledge 44 of a supporting frame 38. Frame 38 extends upwardly from furnace 10 and also functions to directly support the temporary storage bin 26.

Since a high pressure is maintained within furnace 10 during operation thereof, an ascending force is imposed on intermediate storage hopper 18 when valve 24 is in the open condition. The force resulting from furnace pressure will reduce the apparent weight of the hopper. The forces imposed upon intermediate storage hopper 18 with valve 24 open will be proportional to the difference between the cross-sectional area D of upper compensator 34 and the cross-sectional area d of the lower compensator 36. If the area of the two compensators were equal, the results of the weight measurement would not have to be compensated for the pressure induced forces. However, the diameter of compensator 34 is generally greater than that of compensator 36. Since the operating pressure of the furnace is constantly monitored, and the difference between D and d is a known constant, the results of the weighing operation can be automatically corrected by electronic means.

To further discuss the weighing operation, it has been known that the ascending force resulting from pressure may actually exceed the tare. Accordingly, as discussed in U.S. Pat. No. 4,071,166, it was previously considered necessary to prestress or bias the measuring cells in order to insure that they would not operate in their negative zone. In the present invention, as depicted in FIG. 1, the load cells 40 and 42 need not be biased since, due to the presence of the upper compensator 34, the upwardly directed pressure forces do not exceed the tare.

With reference now to FIGS. 2–5, an operational cycle employing the apparatus depicted schematically in FIG. 1 will be described. As used herein, the term "cycle" refers to a single discharge of the contents of the intermediate storage hopper 18 into the furnace 10 and a refilling of hopper 18. The duration of such a "cycle" is determined by the "outward and return journey" of a skip 32 on the ramp 30 including the time required for filling the skip at the bottom of the ramp and dumping the contents thereof into bin 26 at the top of the ramp. The term "cycle" will also be understood to refer to the time period for introducing the contents of two skips into the furnace. During such a "cycle" a complete and uniform layer of material is deposited on the charging surface with the end of spout 12 typically transcribing a spiral path proceeding inwardly from its most outwardly directed position to the center of the furnace; i.e., the discharge chute 12 will spiral inwardly from its shallowest angle with respect to horizontal to the vertical orientation. The flow of material out of hopper 18 must be coordinated with the speed of movement of the discharge chute 12 and for this purpose flow control device 22 will be automatically controlled in accordance with chute speed and position and the results of the weighing operation which determines the contents of hopper 18.

Optimum charging conditions dictate that the operation of the valves 24 and 28 must not occupy the greater part of the duration of a charging "cycle". Similarly, the greater part of a charging "cycle" should not be taken up by idle periods. The accuracy of the control which may be exercised over the charging "cycle" is directly related to the number of turns in the spiral movement transcribed by the end of the distribution chute 12 and thus the movement of the distribution chute should be maximized during each "cycle". These conditions may obviously be more easily fulfilled in accordance with the prior art technique of employing a pair of intermediate storage hoppers which are alternately discharged into the furnace. A principal consideration in accordance with the present invention is that the charging installation itself not limit the speed at which the skips may be loaded and emptied. Another consideration in accordance with the present invention is that the portion of the "cycle" during which material is being delivered into the furnace should be maximized.

Figure 2:
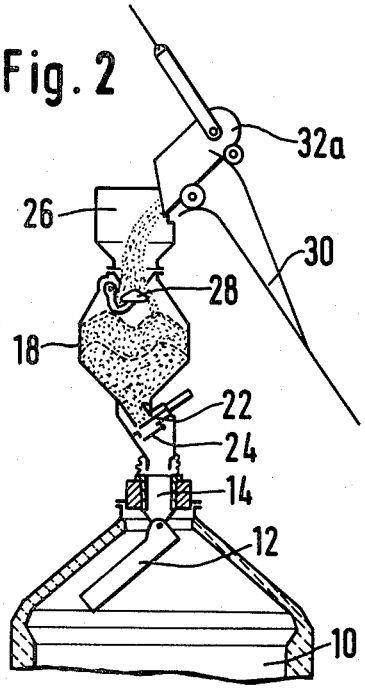
FIGS. 2, 3, 4 and 5 schematically illustrate a furnace charging process employing the apparatus of FIG. 1.
Figure 3:
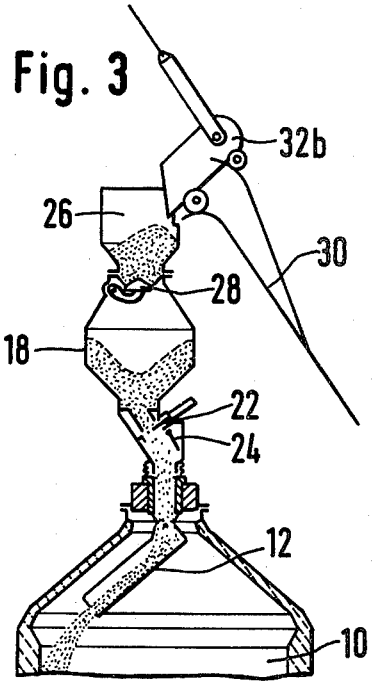

As represented in FIGS. 2–5, the charging installation employs a pair of skips **32*a* and 32*b*. Starting from the portion of the "cycle" shown in FIG. 2, a first skip 32*b* has already discharged its contents into intermediate storage hopper 18 and the contents of skip 32*a* are being directly loaded into intermediate storage hopper 18 through the bin 26 and valve 28. Thus, during the phase of the "cycle" represented by FIG. 2, the lower isolation valve 24 is in the closed condition while valve 28 is in the open condition and the interior of hopper 18 is at atmospheric pressure. As soon as skip 32*a* is empty, valve 28 is closed and the pressure within intermediate storage hopper 18 is raised to a level approximately equal to that prevailing inside furnace 10. The pressurization of hopper 18, and also its depressurization, is effected by means known in the art which have been omitted from the drawing in the interest of facilitating understanding of the invention. As soon as the furnace pressure is established within hopper 18, valve 24 is opened and flow control member 22 withdrawn to the appropriate position so that the charging of the furnace can commence. The furnace charging portion of the "cycle" is depicted in FIG. 3 and it may be seen that the contents of intermediate storage hopper 18 are being distributed on the furnace hearth via the controllable distribution chute 12. During the period required for cycling the valves 24 and 28 and pressurizing the hopper 18, skip 32***a* has descended ramp 30 to the loading station and skip 32*b*, which was filled with material while skip 32*a* was being emptied as shown in FIG. 2, has returned to the top of ramp 30 and is discharging its contents into the temporary storage bin 26. The delivery of material from bin 26 into hopper 18 is prevented at this time by closed valve 28 which is supporting charge material in bin 26.

Figure 4:
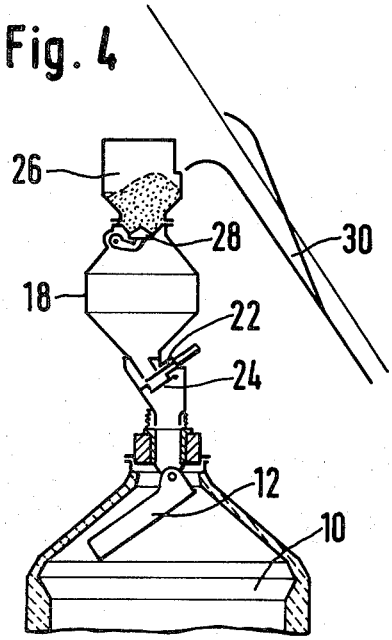
Figure 5:
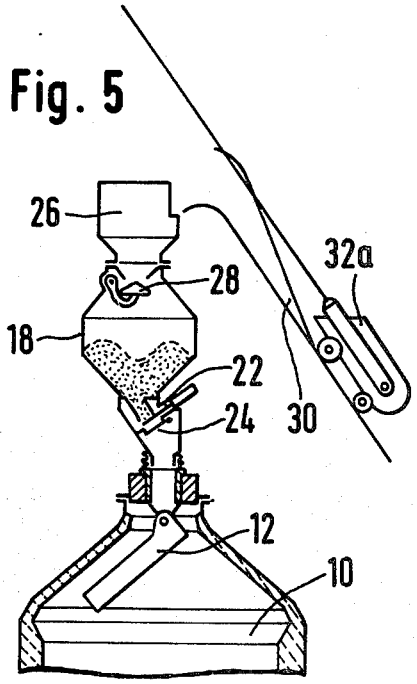

When substantially all of the furnace charge material has been released from hopper 18, the flow control device 22 and valve 24 are returned to the conditon shown in FIG. 2 and the intermediate storage hopper 18 is depressurized. The skip 32*b* will by this time have been emptied and, during depressurization of intermediate storage hopper 18, skip 32*b* will be descending toward the loading station and skip 32*a* will be ascending ramp 30. Valve 28 will, during depressurization of intermediate storage hopper 18, be closed and thus will be retaining the material from skip 32*b* in bin 26 as shown in FIG. 4. When depressurization has been completed, valve 28 will be opened and the contents of bin 26 will be quickly released into intermediate storage hopper 18. As the contents of bin 26 are being released into hopper 18, the full skip 32*a* will be approaching the top of ramp 30 as shown in FIG. 5. When skip 32*a* reaches the top of ramp 30 it will immediately begin to discharge its contents through bin 26 and valve 28 directly into hopper 18 as shown in FIG. 2. During the portion of the "cycle" depicted in FIG. 5, i.e., before skip 32*a* again reaches the top of ramp 30, the operation of this system may be temporarily stopped in order to insure that valve 28 is open and that bin 26 is empty. This verification will be automatically performed.

The apparatus of the present invention, and the operational sequence described above, provides the dual advantages that the flow of furnace charge material does not under normal circumstances interrupt or brake the synchronous alternating operation of the skips 32*a* and 32*b* and that the supply of material from the skips, in turn, does not interrupt the charging operation which occurs during the portion of the "cycle" depicted in FIG. 3. These advantages are as a result of the serial intermediate storage of at least a portion of the furnace charged material in bin 26 and subsequently in intermediate storage hopper 18.

In accordance with a further embodiment of the invention, a charging operation similar to that depicted in FIGS. 2–5 can be carried out with a charging "cycle" corresponding to the filling and emptying of three skips. If three skips are to be employed, the intermediate storage hopper 18 must be sized so as to be at least equal to the contents of three skips and, of course, the charging "cycle" is prolonged. Because of the increase in the time required to discharge the contents of the enlarged hopper 18, the contents of the third skip will be temporarily stored in bin 26 and this, in turn, requires an increase in the size of the bin. As an alternative, if it is either necessary or desirable to avoid increasing the size of the temporary storage bin 26, the third skip may be dumped during the portion of the "cycle" depicted in FIG. 2.

Figure 6:
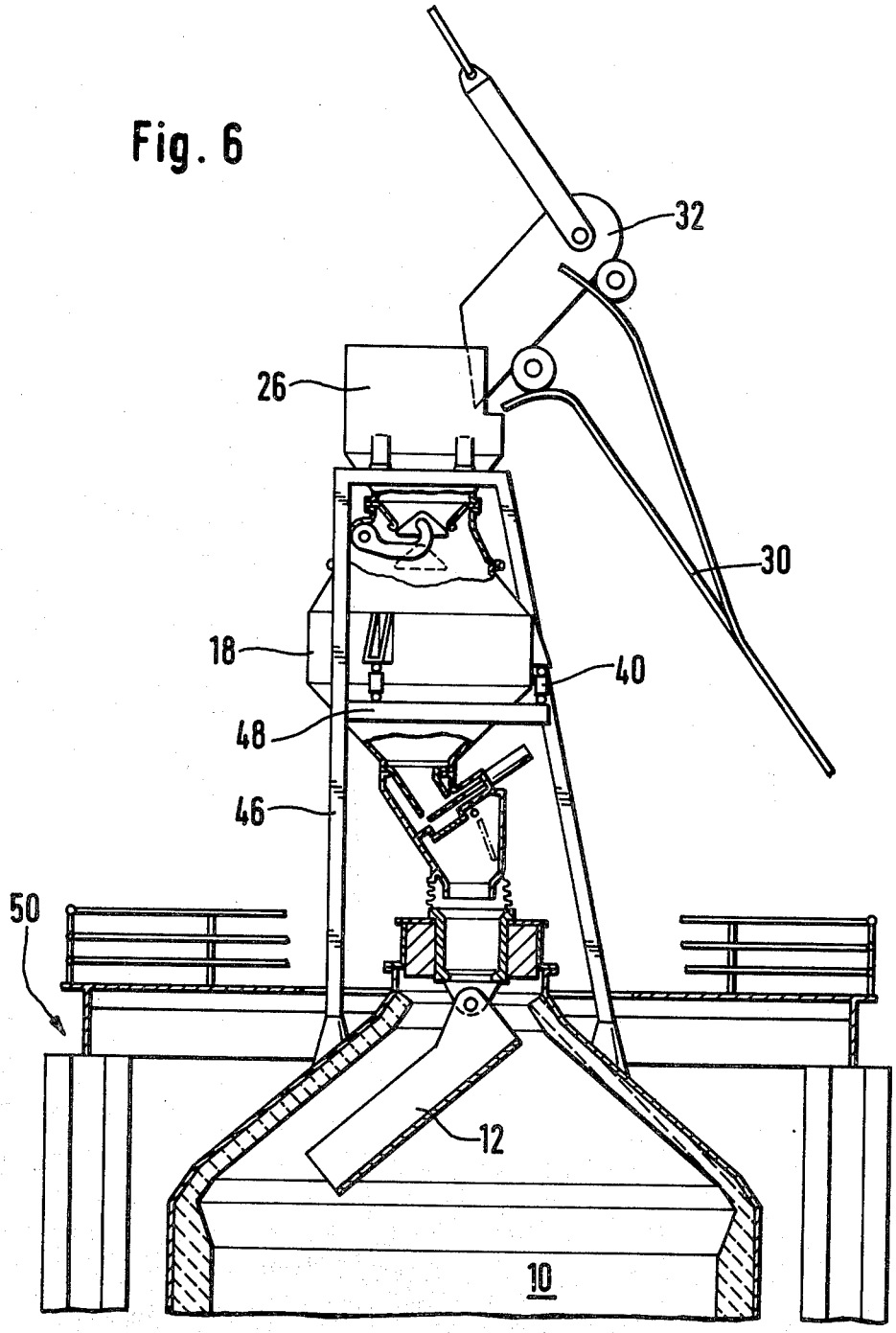
FIG. 6 is a schematic side elevation view, partly in section, depicting installation of the present invention on a first type of shaft furnace.

A charging installation in accordance with the present invention can be designed to be mounted as a single self-contained unit on an existing furnace. FIG. 6 illustrates how the present invention may be mounted on a shaft furnace of the type customarily employed in Europe. The furnace 10 of FIG. 6 is situated within the bounds of a square tower 50 which is designed to support the superstructure and essential items of the charging installation. Thus, in the FIG. 6 environment, the furnace itself does not perform a supporting function for the charging installation and, in the interest of employing the present invention, a "coneless throat" may be installed whereby the opening at the top of the furnace may be reduced when compared to that required for a charging installation which employs conventional charging bells. In the FIG. 6 installation a frame 46 is designed so as to be mounted directly on the furnace. Frame 46, in turn, includes a support beam 48 which, via load cells 40, supports the intermediate storage hopper 18. Frame 46 also supports the bin 26. Since only a single intermediate storage hopper 18 is employed, the overall width of the charging installation is reduced and no modifications have to be made to the existing furnace superstructure. Also, since the vertical axis of the intermediate storage hopper 18 is off-set with respect to the longitudinal axis of the furnace, the charging installation may be positioned so as to mate with an existing ramp 30.

Figure 7:
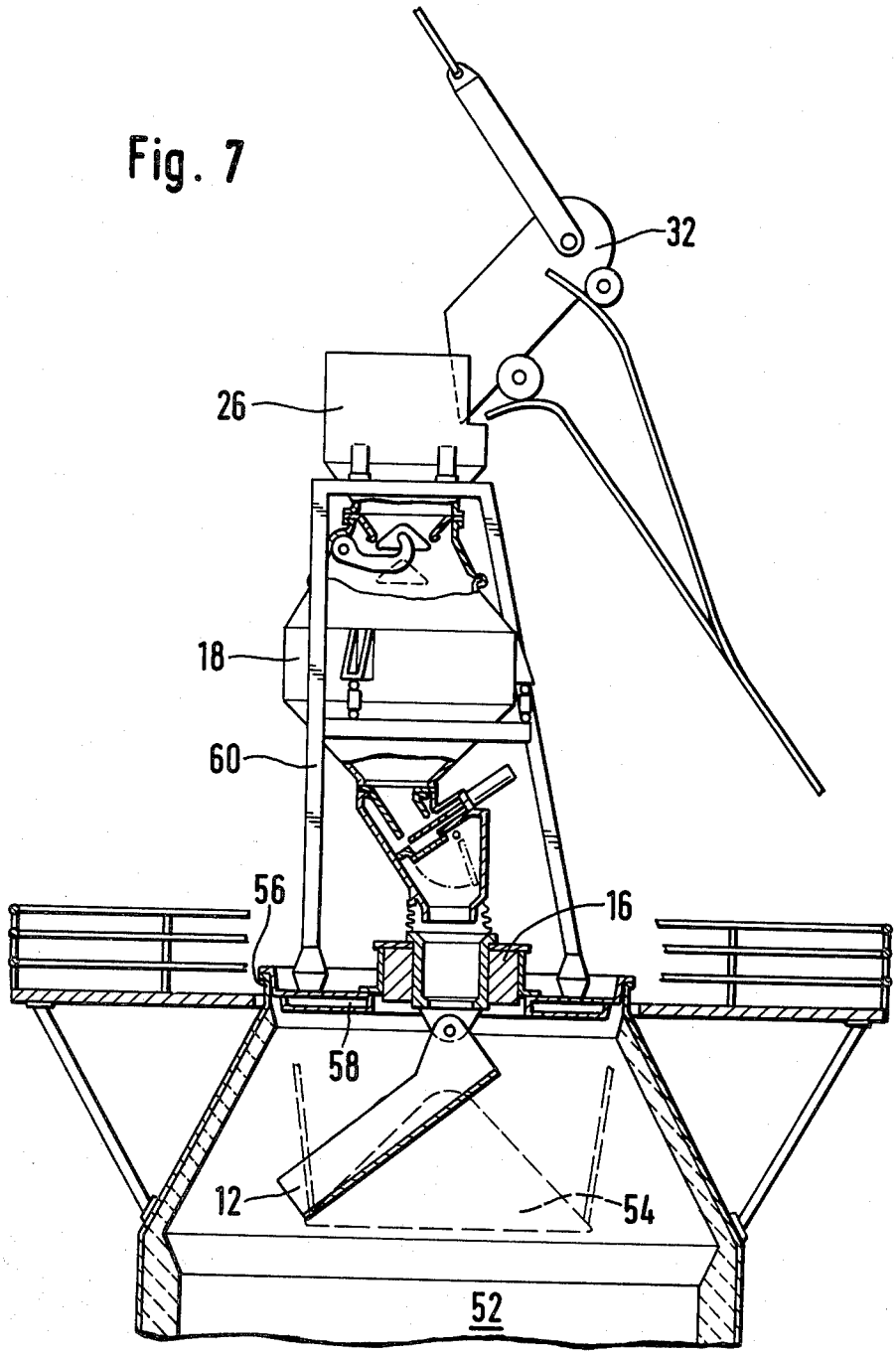
FIG. 7 is a schematic side elevation view, partly in section, depicting installation of the present invention on a second type of furnace.

FIG. 7 illustrates the modernization of a blast furnace 52 of the type commonly employed in North America. In FIG. 7, a "bell less top" charging installation in accordance with the present invention has replaced a bell-type or cone-type charging installation which has been represented at 54 in a broken line showing. Furnace 52 differs from furnace 10 of FIG. 6 in that it functions as the supporting member for the charging installation and auxiliary equipment. Thus, in the environment of FIG. 7, it is not possible to carry out any major conversions or modifications in the upper part of the furnace. In accordance with the present invention, use is made of an existing flange 56 which customarily forms a portion of a prior art bell-type charging system. A "floor" 58 is mounted from flange 56 to reduce the size of the opening at the furnace top. The driving mechanism 16 for the distribution chute 12 is supported above floor 58 as is the frame 60 for supporting the remaining elements of the charging installation. The "floor" 58 may be of hollow construction whereby it can be cooled by circulation of a liquid therethrough to thereby prevent excessive heating and to increase its mechanical strength.

It is significant that in both the FIG. 6 and FIG. 7 installations it is unnecessary to modify the bell tower of a prior charging installation.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. In apparatus for use in the delivery of solid material from the ambient environment into a pressurized furnace, the furnace having a vertical axis and including means internally thereof for distributing the material in a desired pattern, said distributing means including a rotatable material flow directing member, the improvement comprising:

first material storage means, said first storage means including a chamber having vertically displaced material loading and discharge openings, said first storage means being alternately pressurized and depressurized;

frame means, said frame means being supported on and extending upwardly from the upper part of the furnace, said frame means including floor means, said floor means having floor member which extends generally transversely with respect to the furnace axis, said floor member having a centrally disposed opening therein;

means supporting said first storage means on said frame means and above the furnace, said supporting means including a plurality of load cell means for generating signals commensurate with the weight of said first storage means;

first flow control means for selectively establishing and interrupting direct communication between the interior of said first storage means and the interior of the furnace, said first flow control means including material delivery conduit means which extends from said first storage means discharge opening downwardly to a point aligned with a portion of the upper end of the distributing means rotatable member, said first flow control means further including isolation valve means which cooperates with said delivery conduit means whereby said first storage means chamber discharge opening may be placed in communication with the furnace interior through said isolation valve means, said delivery conduit means extending through said aperture in said frame means floor member;

first compensator means, said first compensator means permitting limited vertical movement of said first storage means, said first compensator means establishing a hermetic seal between said first flow control means conduit means and said frame means floor means about the periphery of the opening in said floor member;

second material storage means, said second storage means being fixed in position and being open to the ambient atmosphere at its upper end, said second storage means being supported on said frame means such that its lower end is at a higher elevation than said first storage means loading opening, said second storage means having a discharge opening in its lower end;

second flow control means for selectively establishing and interrupting communication between the interiors of said first and second storage means, said second flow control means including valve means for selectively establishing a hermetic seal between the interiors of said first and second storage means and permitting material flow from said second storage means into said first storage means under the influence of gravity; and second compensator means, said second compensator means permitting limited relative vertical motion between said first and second storage means, said second compensator means establishing a flexible hermetic joint between said first storage means and said second flow control means.

2. The apparatus of claim 1 wherein said second flow control means valve means includes a valve member which in part supports the material in said second storage means when in the closed position.

3. The apparatus of claim 2 wherein said material supporting valve member is shaped to guide material released from said second storage means so as to cause said material to fall in an annular pattern.

4. The apparatus of claim 3 wherein said frame means floor member comprises:

a partition having an interior portion which defines a path for the circulation of a coolant.

5. The apparatus of claim 1 wherein said said frame means floor member comprises:

a partition having an interior portion which defines a path for the circulation of a coolant.

* * * * *